US009175459B2

(12) United States Patent
Zhang et al.

(10) Patent No.: US 9,175,459 B2
(45) Date of Patent: Nov. 3, 2015

(54) WATER SUPPLY DEVICE WITH DOUBLE SUPPLY MODES

(71) Applicant: Globe Union Industrial Corp., Taichung (TW)

(72) Inventors: Changwen Zhang, Shen Zen (CN); Bo Li, Shen Zen (CN); Carter Xie, Shen Zen (CN)

(73) Assignee: Global Union Industrial Corp., Taichung (TW)

( * ) Notice: Subject to any disclaimer, the term of this patent is extended or adjusted under 35 U.S.C. 154(b) by 141 days.

(21) Appl. No.: 14/140,594

(22) Filed: Dec. 26, 2013

(65) Prior Publication Data

US 2015/0184366 A1 Jul. 2, 2015

(51) Int. Cl.
*E03C 1/04* (2006.01)

(52) U.S. Cl.
CPC ..... *E03C 1/0405* (2013.01)

(58) Field of Classification Search
CPC ..... E03C 1/0404
USPC ..... 4/675–678
See application file for complete search history.

(56) References Cited

U.S. PATENT DOCUMENTS 6,370,713 B2 * 4/2002 Bosio ..... E03C 1/05 239/441
7,331,536 B1 * 2/2008 Zhen ..... B05B 1/1618 137/625.48
7,344,095 B1 * 3/2008 Hsu ..... B05B 1/1618 239/444
7,380,731 B1 * 6/2008 Hsu ..... B05B 1/1618 239/391
7,717,362 B2 * 5/2010 Beh ..... E03C 1/0404 239/525
7,748,406 B2 * 7/2010 Pilatowicz ..... E03C 1/08 137/603
7,871,020 B2 * 1/2011 Nelson ..... E03C 1/0404 137/801
8,424,569 B2 * 4/2013 Marty ..... E03C 1/0404 137/613
8,939,429 B2 * 1/2015 Sawaski ..... E03C 1/057 251/129.04

* cited by examiner

*Primary Examiner* — Lori Baker
(74) *Attorney, Agent, or Firm* — Alan D. Kamrath; Kamrath IP Lawfirm, P.A.

(57) ABSTRACT

A water supply device with double supply modes contains: a body, a shifting mechanism, and a magnetic attraction device. The body includes an inflow channel, a water distributing cavity, a first outflow channel and a second outflow channel. The shifting mechanism includes a press button, a distribution core having a connecting portion and a closing portion, the closing portion moves between a first closing portion and a second closing portion reciprocatingly after the press button is pressed. The magnetic attraction device includes a first attracting element and a second attracting element which magnetically attract each other. The first attracting element is disposed on the shifting mechanism, and the second attracting element is mounted in the body opposite to the first attracting element; and the first attracting element moves to the first closing position or the second closing position with the distribution core.

18 Claims, 12 Drawing Sheets

WATER SUPPLY DEVICE WITH DOUBLE SUPPLY MODES

FIELD OF THE INVENTION

The present invention relates to a water supply device with double supply modes.

BACKGROUND OF THE INVENTION

A conventional water supply device with two shifting levels are widely applied in kitchen equipment (such as a pull-out faucet) or showering equipment (such as a shower head). This water supply device has two shifting levels for controlling water supply modes. For example, the water supply device is shifted to a bubble level and a water level. When the water supply device is shifted to the bubble level so as to spray waters with bubbles, waters are sprayed out of a bubbler via an outlet end of a first outflow channel. When the water supply device is shifted to the water level so as to spray waters, the waters are sprayed out of plural nozzles via an outlet end of a second outflow channel.

A conventional pull-out faucet for kitchen contains a spray head and a hose fixed in the faucet body and connecting with the spray head, such that the spray head and the hose can be pulled outwardly together, thereafter they are stored in the faucet body. This pull-out faucet is pressed to shift water supply modes and is disclosed in U.S. Pat. No. 6,370,713.

When the pull-out faucet is turned off, an elastic restoring force of a spring in the faucet body pushes a flow controlling element to move to a first closing fence so that when the pull-out faucet is turned on again, it keeps in a bubble level. After a press button on a driving lever is pressed, the flow controlling element on a push post is driven to contact with a second closing fence, thus shifting the bubble level to the water level.

Thereby, water pressure in a water channel acts the second closing fence opposite to the flow controlling element so as to resist against the elastic recovering force, thus operating spray head easily.

As desiring to return back to the bubble level, a distal end of the driving lever is pressed so that the push post and the flow controlling element are pulled back to their original positions. After the pull-out faucet is turned off, the water pressure in the water channel vanishes so that the push post and the flow controlling element are driven by the elastic recovering force to move back to a position which controls the water to flow out of the spray head with bubbles.

However, such a conventional pull-out faucet still has disadvantages, for example, after the pull-out faucet is turned on, the water pressure in the water channel acts on the flow controlling element to resist against elastic recovering force of the spring, but the water pressure is too low or too instable to resist against the elastic recovering force, thus flowing water with bubbles in water level. In addition, the flow controlling element cannot be controlled to automatically return back to the bubble level. In order to stop such a situation, the spray head has to be pressed continuously, thus causing operational inconvenience.

If a water closing area of the flow controlling element is increased to enhance water pressure, the flow controlling element is hit by increased water pressure, thereby causing operational inconvenience.

When the pull-out faucet is in the water level and a distal end of the driving lever is pressed or the pull-out faucet is turned off, the push post and the flow controlling element are driven by the elastic recovering force to move back to the bubble level. However, after the spring pushes the flow controlling element and the push post, it is in a compression minimum, the elastic recovering force is so small that the flow controlling element cannot be closed completely, hence water flows in the bubble level and the water level together.

The present invention has arisen to mitigate and/or obviate the afore-described disadvantages.

SUMMARY OF THE INVENTION

The primary object of the present invention is to provide a water supply device with double supply modes which is capable of overcoming the shortcomings of the conventional water supply device.

To obtain the above objectives, a water supply device with double supply modes provided by the present invention contains: a body, a shifting mechanism, and a magnetic attraction device.

The body includes an inflow channel, a water distributing cavity communicating with the inflow channel, a first outflow channel and a second outflow channel which communicate with the water distributing cavity; the first outflow channel is arranged to produce a first water supply mode; the second outflow channel is configured to produce a second water supply mode.

The shifting mechanism includes a press button connected with the body so as to swing frontward and backward after being pressed by a user; a distribution core having a connecting portion movably coupled with the press button and a closing portion located in the water distributing cavity of the body, the closing portion moves between a first closing portion and a second closing portion after the press button is pressed; when the closing portion moves to the first closing position, it stops the water distributing cavity communicating with the second outflow channel and guides waters in the water distributing cavity to flow into the first outflow channel; when the closing portion moves to the second closing position, it stops the water distributing cavity communicating with the first outflow channel and guides the waters in the water distributing cavity to flow into the second outflow channel.

The magnetic attraction device includes a first attracting element and a second attracting element which magnetically attract each other; the first attracting element is disposed on the shifting mechanism; the second attracting element is mounted in the body opposite to the first attracting element; and the first attracting element moves to the first closing position with the distribution core so as to be close to the second attracting element, and the first attracting element moves to the second closing position with the distribution core so as to be away from the second attracting element.

Preferably, the shifting mechanism further includes a resilient element for pushing the distribution core so that the closing portion of the distribution core moves back to the first closing position from the second closing position.

Preferably, the first attracting element is a magnet or is made of magnetic material, and the second attracting element is a magnet or is made of magnetic material.

Preferably, the first attracting element is a magnet or is made of magnetic material, and the second attracting element is a magnet or is made of magnetic material.

Preferably, the first outflow channel of the water outflow part has a bubbler disposed on an outlet end thereof and located at a central portion of the water outflow part as to produce the first water spray mode to spray waters with bubbles; the second outflow channel of the water outflow part has a plurality of nozzles formed on the outlet end thereof and surrounding around the bubbler so as to produce the second water spray mode to spray waters.

Preferably, the magnetic attraction device further includes a third attracting element disposed on the shifting mechanism and a fourth attracting element mounted in a body relative to the third attracting element, such that the third attracting element moves close to the fourth attracting element when it moves to the second closing position with the distribution core; and the third attracting element moves away from the fourth attracting element when it moves to the first closing position with the distribution core.

Preferably, the shifting mechanism further includes a resilient element, and the resilient element is a compression spring for abutting against the distribution core, such that the closing portion of the distribution core moves back to the first closing position from the second closing position; when the closing portion of the distribution core is located at the second closing position, the resilient element has a largest elastic recovering force, a shortest distance between the third attracting element and the fourth attracting element produces, and a largest magnetic attraction force generates between the third attracting element and the fourth attracting generates, and the largest magnetic attraction force is less than the largest elastic recovering force.

Preferably, when the closing portion of the distribution core is located at the second closing position, a farthest distance between the first attracting element and the second attracting element generates, and a smallest magnetic attraction force generates between the first attracting element and the second attracting produces, and the smallest magnetic attraction force is less than the largest magnetic attraction force between the third attracting element and the fourth attracting element.

Thereby, the water supply device of the present invention has the following advantages:

1. When the water supply device is turned on, it maintains in the start level (i.e., the bubble level) stably.

2. The water supply device is shifted from the bubble level to the water level or is shifted from the water level to the bubble level smoothly.

3. The water supply device is shifted from the bubble level to the water level or is shifted from the water level to the bubble level easily at high water pressure.

DETAILED DESCRIPTION OF THE PREFERRED EMBODIMENTS

Figure 1:
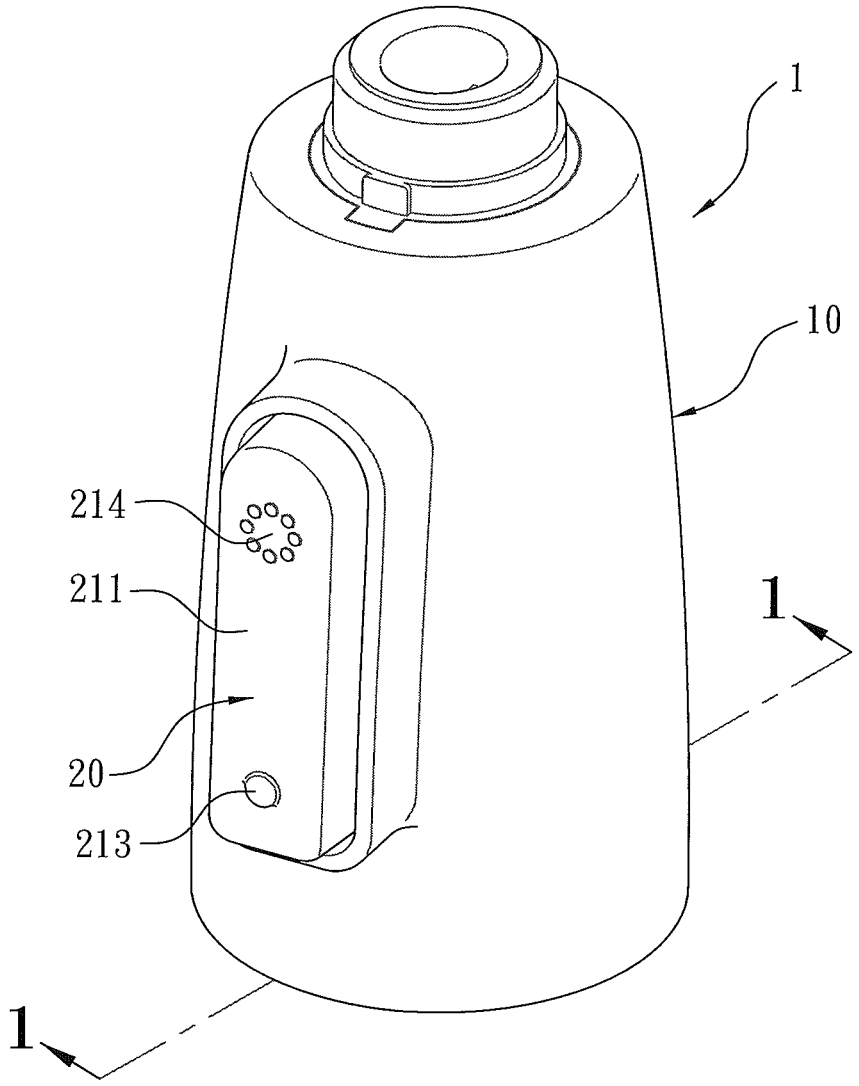
FIG. 1 is a perspective view showing the assembly of a water supply device with double supply modes according to a first embodiment of the present invention.

Referring further to FIGS. 1-4, a water supply device with double supply modes according to a first embodiment of the present invention is a pull-out faucet 1, the pull-out faucet 1 includes a body 10, a shifting mechanism 20, and a magnetic attraction device 30.

The body 10 includes an inflow channel 11, a water distributing cavity 12 communicating with the inflow channel 11, a first outflow channel 13 and a second outflow channel 14 which communicate with the water distributing cavity 12; the first outflow channel 13 is arranged to produce a first water supply mode; the second outflow channel 14 is configured to produce a second water supply mode.

Figure 2:
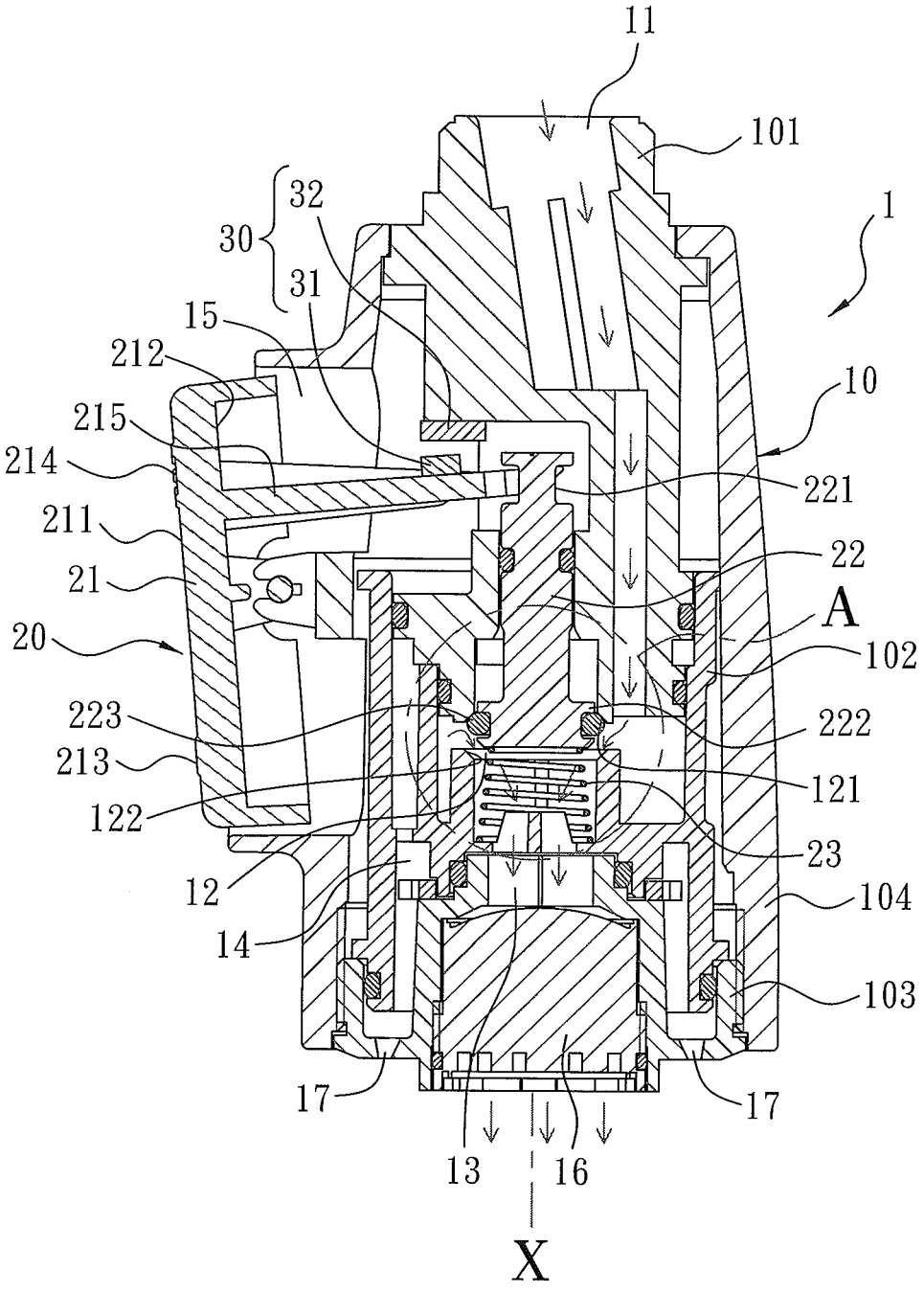
FIG. 2 is a cross sectional view taken along the line 1-1 of FIG. 1 and showing the operation of the water supply device with double supply modes according to the first embodiment of the present invention, wherein a closing portion of a distribution core is located at a first closing position, and a pull-out faucet is in a bubble level.
Figure 3:
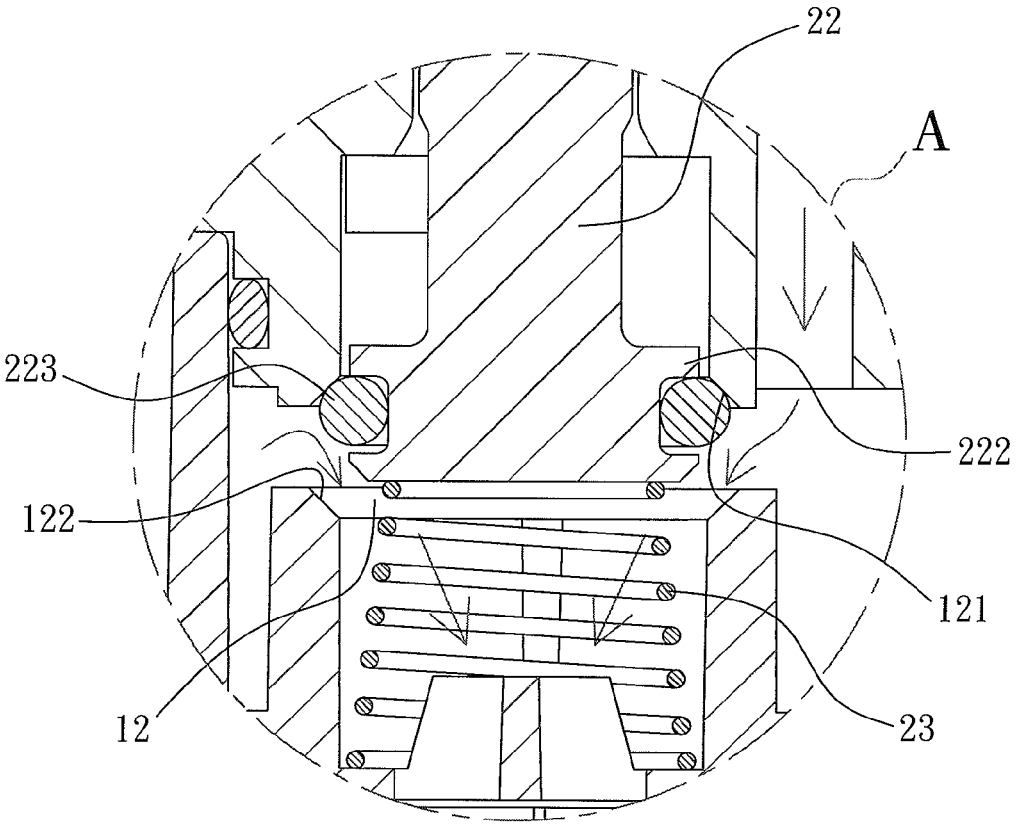
FIG. 3 is a cross sectional view of a portion A of FIG. 2.
Figure 4:
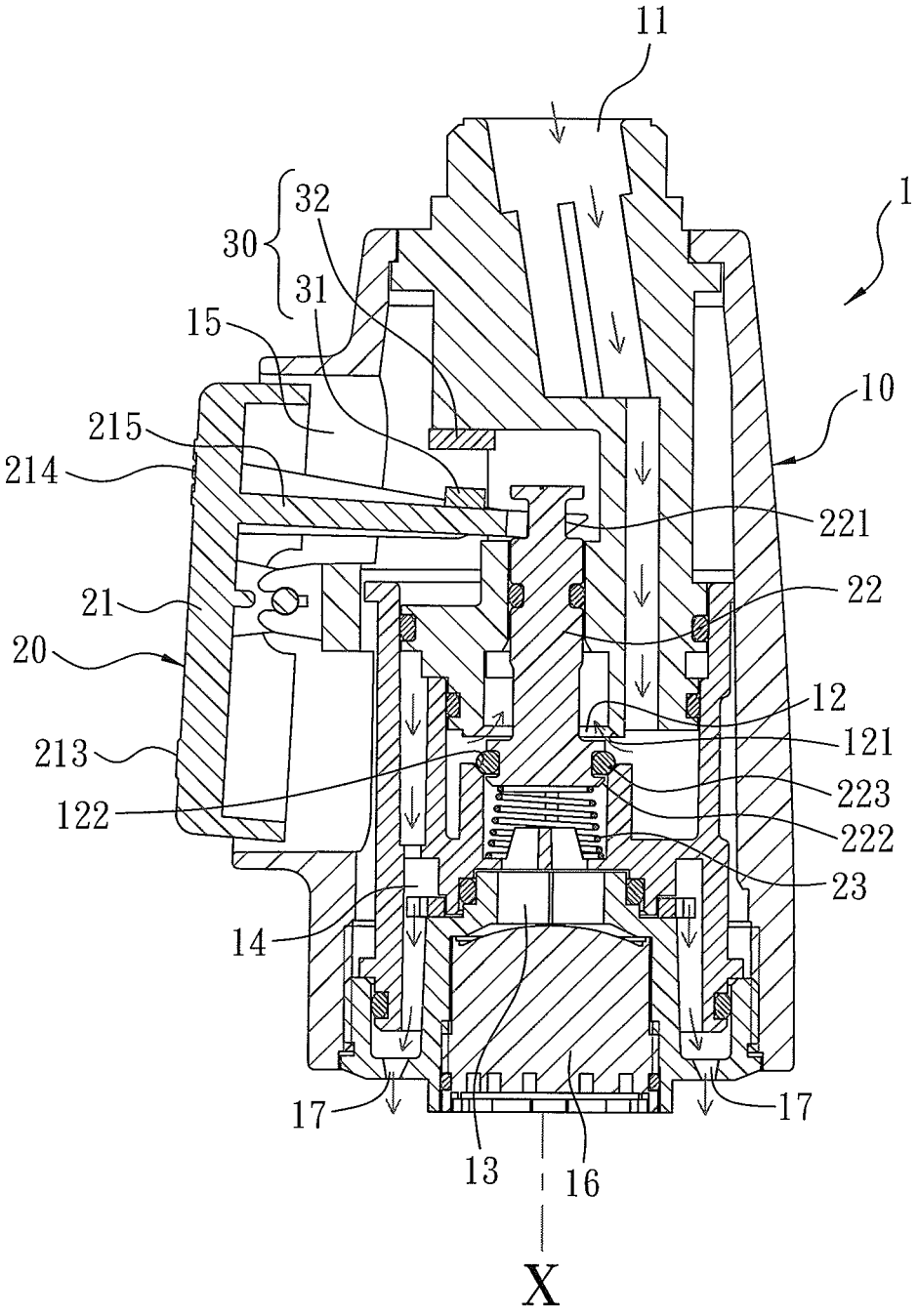
FIG. 4 is a cross sectional view showing the operation of the water supply device with double supply modes according to the first embodiment of the present invention, wherein the closing portion of the distribution core is located at a second closing position, and the pull-out faucet is in a water level.

The shifting mechanism 20 includes a press button 21, a distribution core 22, and a resilient element 23; wherein the press button 21 is connected with the body 10 so as to swing forward and backward after being pressed;

the distribution core 22 has a connecting portion 221 movably coupled with the press button 21 and a closing portion 222 located in the water distributing cavity 12 of the body 10, the closing portion 222 moves between a first closing portion and a second closing portion reciprocatingly after the press button 21 is pressed to shift water supply mode, as shown in FIGS. 2 and 3, such that when the closing portion 222 moves to the first closing position, it stops the water distributing cavity 12 communicating with the second outflow channel 14 and guides waters in the water distributing cavity 12 to flow into the first outflow channel 13; as illustrated in FIG. 4, when the closing portion 222 moves to the second closing position, it stops the water distributing cavity 12 communicating with the first outflow channel 13 and guides the waters in the water distributing cavity 12 to flow into the second outflow channel 14;

the resilient element 23 is a compression spring for pushing the distribution core 22 so that the closing portion 222 of the distribution core 22 moves back to the first closing position from the second closing position.

The magnetic attraction device 30 includes a first attracting element 31 and a second attracting element 32 which magnetically attract each other; the first attracting element 31 is disposed on the shifting mechanism 20; the second attracting element 32 is mounted in the body 10 opposite to the first attracting element 31, and the first attracting element 31 moves to the first closing position with the distribution core 22 so as to be close to the second attracting element 32, as shown in FIG. 2, and the first attracting element 31 moves to the second closing position with the distribution core 22 so as to be away from the second attracting element 32 as illustrated in FIG. 4.

The first attracting element 31 is a magnet or is made of magnetic material, and the second attracting element 32 is a magnet or is made of magnetic material. In this embodiment, each of the first attracting element 31 and the second attracting element 32 is a magnet.

In this embodiment, the press button 21 has an external face 211 for being pressed by a user and an internal face 212 coupling with the body 10; the external face 211 has a first pressing portion 213 fixed on a first side thereof and a second pressing portion 214 secured on a second side thereof, such that when the first pressing portion 213 is pressed, the distribution core 22 is driven to move toward the first closing position, and when the second pressing portion 214 is pressed, the distribution core 22 is driven to move toward the second closing position.

In this embodiment, the internal face 212 further has a horizontal post 215 extending outwardly therefrom so as to join with the distribution core 22 and to fix the first attracting element 31 to adjacent to a distal end of the horizontal post 215, and the second attracting element 32 is disposed on an inner wall of the body 10 opposite to the first attracting element 31.

Referring to FIGS. 1-4, the body 10 further includes a water inflow part 101, a water allocating part 102 connecting with an outlet end of the water inflow part 101, a water outflow part 103 coupling with an outlet end of the water allocating part 102, and a housing part 104 for accommodating the water inflow part 101, the water allocating part 102, and the water outflow part 103.

The water inflow part 101 has the inflow channel 11 formed thereon; between the water inflow part 101 and the water allocating part 102 is defined the water distributing cavity 12; the water allocating part 102 has most part of the second outflow channel 14 arranged thereon; the water outflow part 103 has the first outflow channel 13 and an outlet end of the second outflow channel 14; the housing part 104 has a receiving groove 15 defined thereon so as to fix the press button 21.

In this embodiment, the water distributing cavity 12 includes a first sealing fence 121 and a second sealing fence 122, the first sealing fence 121 is formed by the water inflow part 101, and the second sealing fence 122 is formed by the water allocating part 102. The closing portion 222 of the distribution core 22 has a gasket 223 fitted thereon so that when the gasket 223 is located at the first closing position, it closes the first sealing fence 121 to stop the water distributing cavity 12 communicating with the second outflow channel 14, and when the gasket 223 is located at the second closing position, it closes the second sealing fence 122 to stop the water distributing cavity 12 communicating with the first outflow channel 13.

In this embodiment, the first outflow channel 13 of the water outflow part 103 has a bubbler 16 disposed on an outlet end thereof and located at a central portion of the water outflow part 103 so as to produce the first water spray mode to spray waters with bubbles; the second outflow channel 14 of the water outflow part 103 of has a plurality of nozzles 17 formed on the outlet end thereof and surrounding around the bubbler 16 so as to produce the second water spray mode to spray waters.

In this embodiment, the resilient element 23 is installed in the water distributing cavity 12 and has two ends for abutting against the water outflow part 103 and the distribution core 22.

In this embodiment, when the pull-out faucet 1 is in a closing state, an elastic recovering force of the resilient element 23 acts on the distribution core 22 so that the closing portion 222 of the distribution core 22 is located at the first closing position as shown in FIGS. 2 and 3. In other words, the gasket 223 on the closing portion 222 abuts against the first sealing fence 121 of the water distributing cavity 12 so as to stop the water distributing cavity 12 communicating with the second outflow channel 14, hence when the pull-out faucet 1 is turned on, the waters in the water distributing cavity 12 is guided to flow to the first outflow channel 13 and then flows out of the bubbler 16, thus spraying waters with bubbles. A start level of the pull-out faucet 1 is a bubble level accordingly.

When the second pressing portion 214 of the press button 21 is pressed, the distribution core 22 is driven to move downwardly toward the second closing position along an axis line X as illustrated in FIG. 4, and the gasket 223 is biased against the second sealing fence 122 of the water distributing cavity 12 so as to stop the water distributing cavity 12 communicating with the first outflow channel 13, such that the waters in the water distributing cavity 12 is guided to flow into the second outflow channel 14 and then flows out of the plurality of nozzles 17, thus shifting to water level (i.e., spraying waters).

In addition, the first pressing portion 213 of the press button 21 is pressed to drive the distribution core 22 to move upwardly along the X axis line so that the closing portion 222 is shifted to move toward the first closing position as illustrated in FIGS. 2 and 3, thus shifting back to the first water spray mode (i.e., spraying waters with bubbles). After the pull-out faucet 1 is turned off, the closing portion 222 of the distribution core 22 is pushed by the resilient element 23 to move back to the first closing position, thus returning to the start level automatically.

It is to be noted that when the pull-out faucet 1 is in the start level as shown in FIGS. 2 and 3, i.e., the closing portion 222 of the distribution core 22 is located at the first closing position, the distribution core 22 is pushed by the resilient element 23, but the elastic recovering force of the resilient element 23 is in a minimum, so the gasket 223 of the closing portion 222 cannot abut against the first sealing fence 121 stably. To improve such a problem, the first attracting element 31 and the second attracting element 32 of the magnetic attraction device 30 are provided in this embodiment. For example, when the closing portion 222 of the distribution core 22 is located at the first closing position, the first attracting element 31 keeps a shortest distance from the second attracting element 32 so as to generate maximum magnetic attraction force to supplement the elastic recovering force of the resilient element 23 or to use the maximum magnetic attraction force to drive the gasket 223 so that the gasket 223 abuts against the first sealing fence 121 stably. In other words, the maximum magnetic attraction force not only can supplement the elastic recovering force of the resilient element 23 but also can replace the elastic recovering force completely.

A start level (i.e., bubble level) of a conventional pull-out faucet is maintained by ways of the resilient element, so a high elastic recovering force of the resilient element 23 is indispensable. However, the maximum magnetic attraction force between the first attracting element 31 and the second attracting element 32 of the present invention lowers the requirement of the elastic recovering force of the resilient element 23. Preferably, when the elastic recovering force of the resilient element 23 is in a maximum, the resilient element 23 pushes the distribution core 22 to move upwardly along the axis line X so that the first attracting element 31 moves close to the second attracting element 32 to produce the maximum magnetic attraction force. In other words, the elastic recovering force of the resilient element 23 is merely applied to push the distribution core 22, so only the resilient element 23 with smaller elastic recovering force is required for the prevent invention. For instance, when the pull-out faucet 1 is pressed to shift to a water level, the closing portion 222 of the distribution core 22 is located at the second closing position to obtain the smaller elastic recovering force of the resilient element 23 so as to reduce water-pressure requirement, such that when water pressure is low or instable, it still can resist against the elastic recovering force of the resilient element 23, and the gasket 223 of the closing portion 222 is biased against the second sealing fence 122 of the water distributing cavity 12 tightly. It is to be noted that when the closing portion 222 of the distribution core 22 is located at a second closing position, a farthest distance generates between the first attracting element 31 and the second attracting element 32, so the magnetic attraction force between the first attracting element 31 and the second attracting element 32 will not occur or only tiny magnetic attraction force occurs, hence the tiny magnetic attraction force will not interfere the resilient element 23.

Also, the bubble level and the water level are shifted easily at high water pressure.

Figure 5:
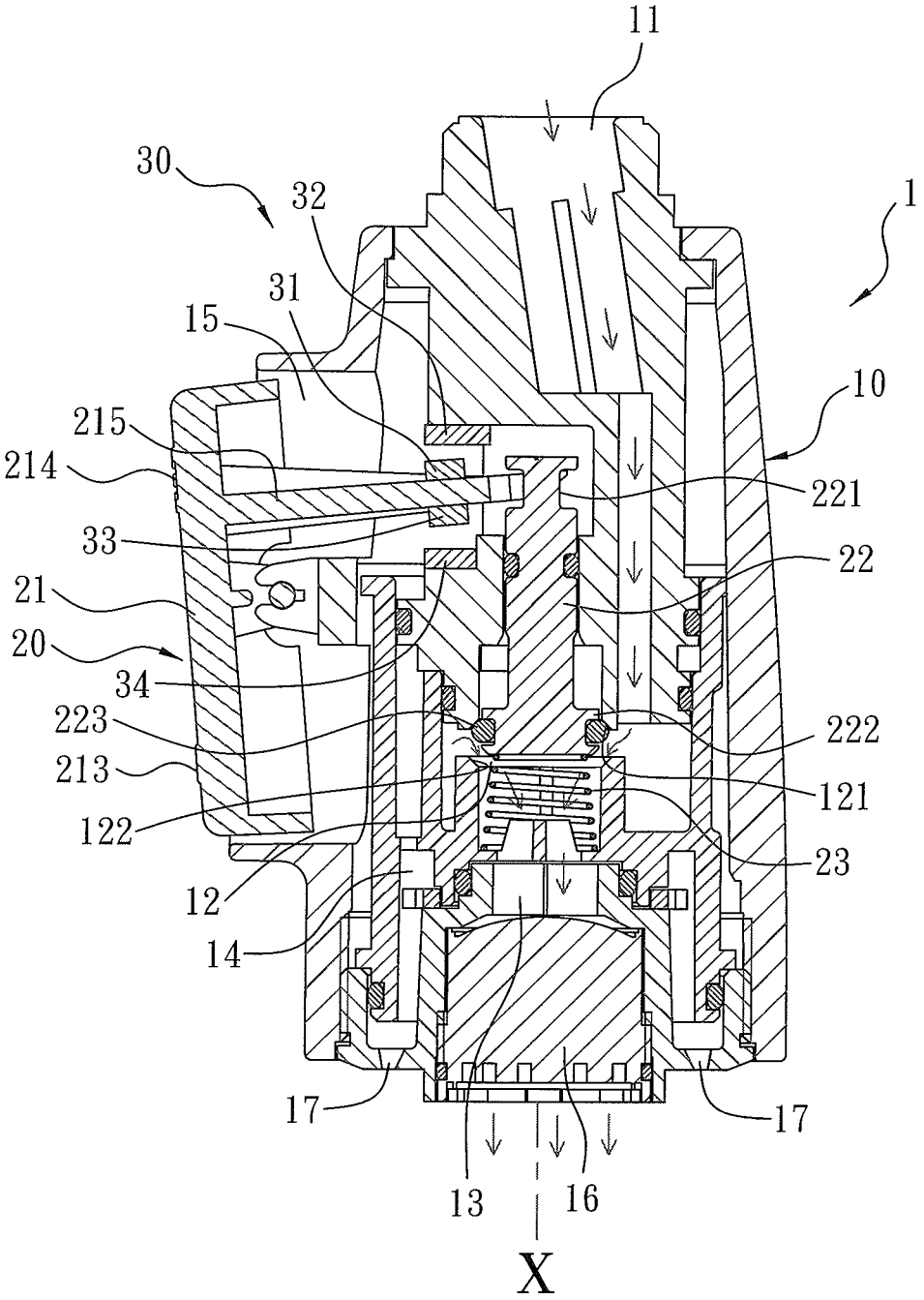
FIG. 5 is a cross sectional view showing the operation of a water supply device with double supply modes according to a second embodiment of the present invention, wherein a closing portion of a distribution core is located at a first closing position, and a pull-out faucet is in a bubble level.
Figure 6:
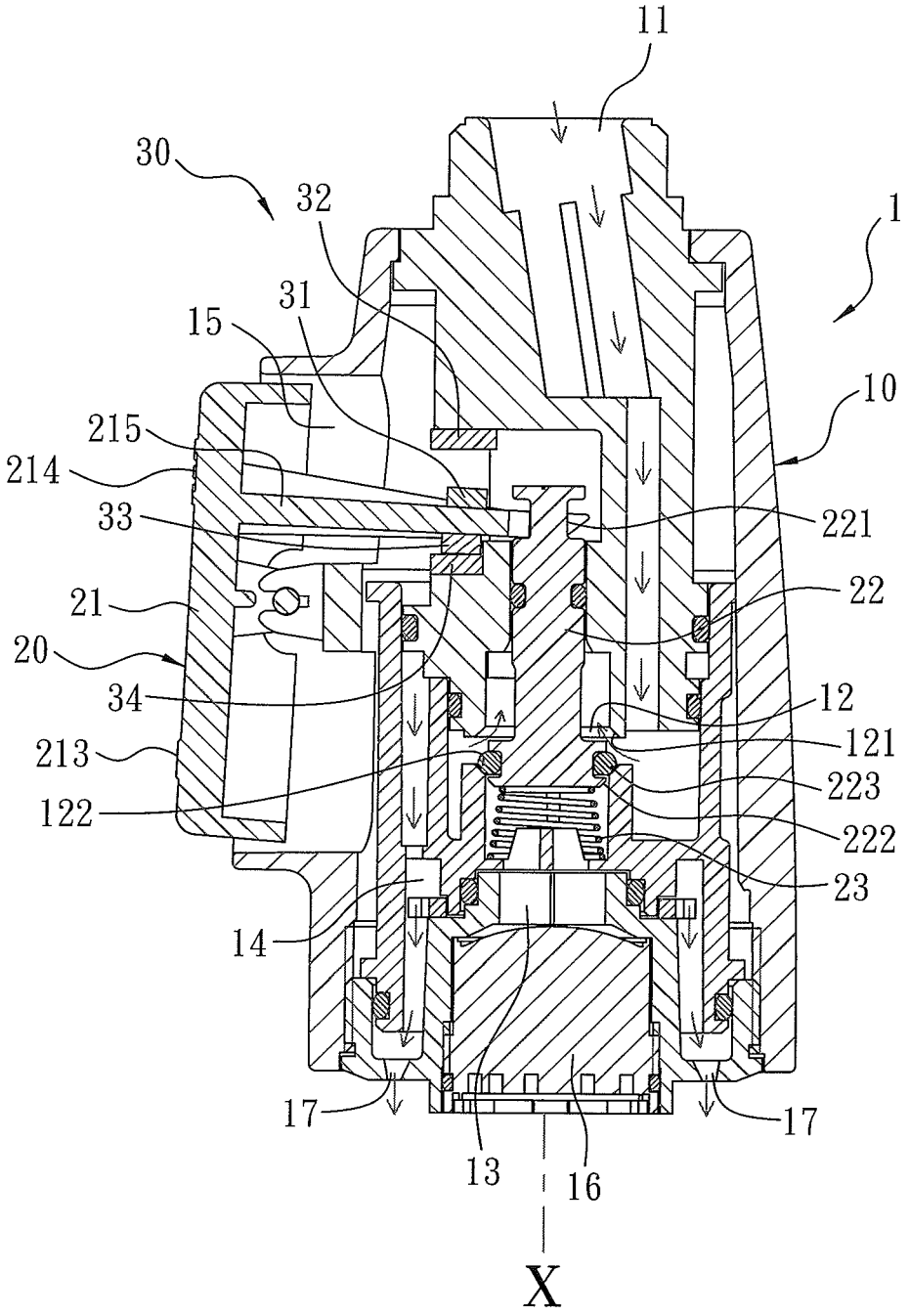
FIG. 6 is a cross sectional view showing the operation of the water supply device with double supply modes according to the second embodiment of the present invention, wherein the closing portion of the distribution core is located at a second closing position, and the pull-out faucet is in a water level.

With reference to FIGS. 5 and 6, a difference of a water supply device with double supply modes of a second embodiment from that of the first embodiment comprises:

a magnetic attraction device 30 including a first attracting element 31, a second attracting element 32, a third attracting element 33, and a fourth attracting element 34; wherein the third attracting element 33 is disposed on a shifting mechanism 20; the fourth attracting element 34 is mounted in a body 10 relative to the third attracting element 33, such that the third attracting element 33 moves close to the fourth attracting element 34 when it moves to a second closing position with a distribution core 22; and the third attracting element 33 moves away from the fourth attracting element 34 when it moves to a first closing position with the distribution core 22.

In this embodiment, the first attracting element 31 and the third attracting element 33 are fixed on two opposite sides of the horizontal post 215 adjacent to a distal end of the horizontal post 215, and the second attracting element 32 is secured on an inner wall of the body 10 opposite to the first attracting element 31, the fourth attracting element 34 is arranged on the inner wall of the body 10 opposite to the third attracting element 33.

Referring to FIG. 6, when the closing portion 222 of the distribution core 22 is located at the second closing position, the resilient element 23 has largest elastic recovering force, and a distance between the third attracting element 33 and the fourth attracting element 34 is shortest, a magnetic attraction force between the third attracting element 33 and the fourth attracting element 34 is largest, such that largest magnetic attraction force between the third attracting element 33 and the fourth attracting element 34 resists against the elastic recovering force of the resilient element 23 at lower or insufficient water pressure so that the pull-out faucet 1 is maintained at water level stably.

Thereby, the magnetic attraction force between the third attracting element 33 and the fourth attracting element 34 supplements the lower or the insufficient water pressure so that the pull-out faucet 1 is maintained at the water level stably. In other words, the magnetic attraction force between the third attracting element 33 and the fourth attracting element 34 offsets the elastic recovering force of the resilient element 23 at largest compression maximum, thus keeping an original size of the resilient element 23.

To shift the water level of the pull-out faucet 1 to a bubble level as turning off the pull-out faucet 1, the largest magnetic attraction force between the third attracting element 33 and the fourth attracting element 34 is limited to be less than the elastic recovering force of the resilient element 23 at largest compression maximum, thus shifting the water level to the bubble level smoothly.

When the closing portion 222 of the distribution core 22 is located at the second closing position, the resilient element 23 has largest elastic recovering force, the farthest distance generates between the first attracting element 31 and the second attracting element 32, a tiny magnetic attraction force between the first attracting element 31 and the second attracting element 32 produces and is less than the magnetic attraction force between the third attracting element 33 and the fourth attracting element 34, such that the tiny magnetic attraction force will not interfere the resilient element 23.

Figure 7:
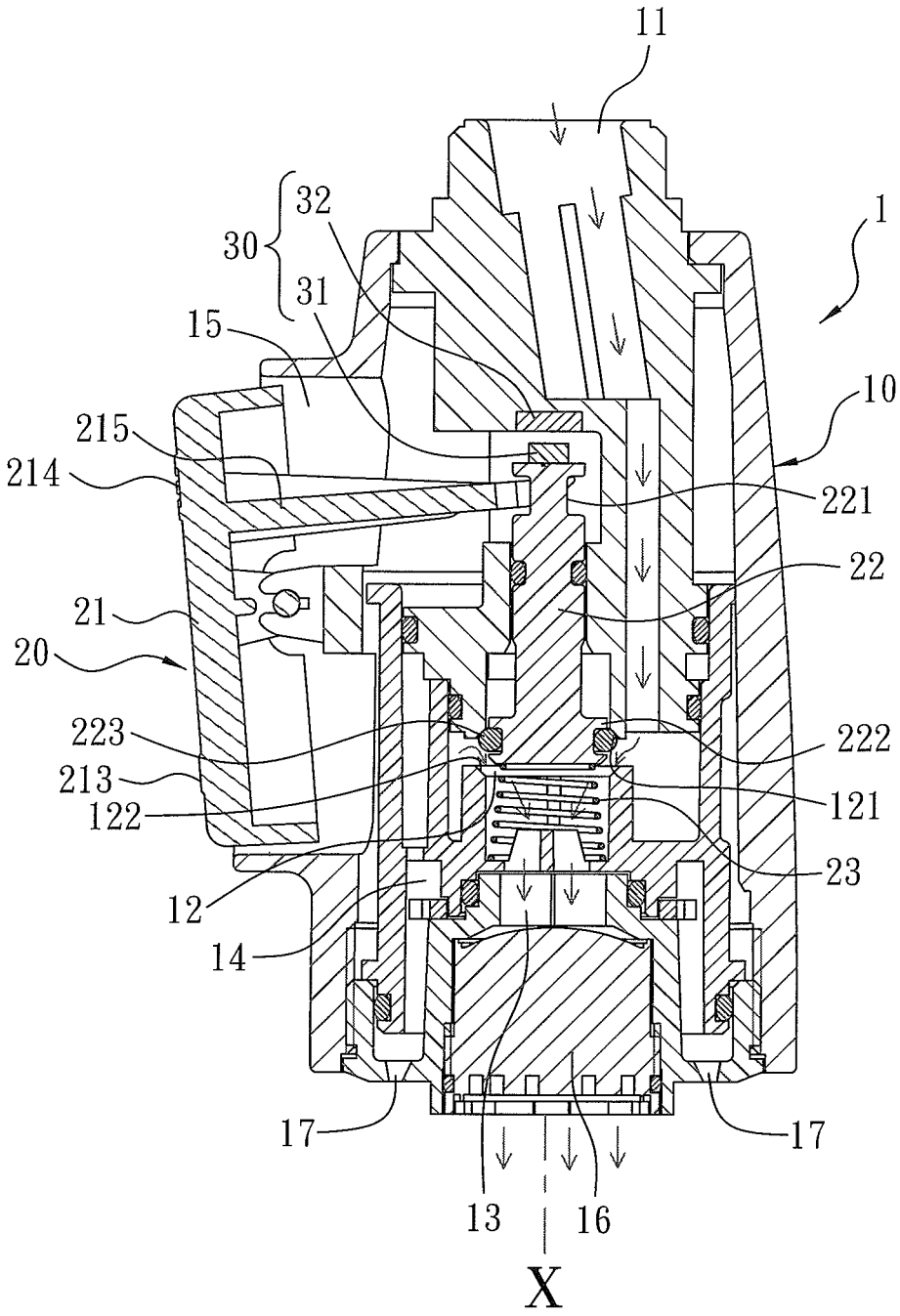
FIG. 7 is a cross sectional view showing the operation of a water supply device with double supply modes according to a third embodiment of the present invention, wherein a closing portion of a distribution core is located at a first closing position, and the pull-out faucet is in a bubble level.
Figure 8:
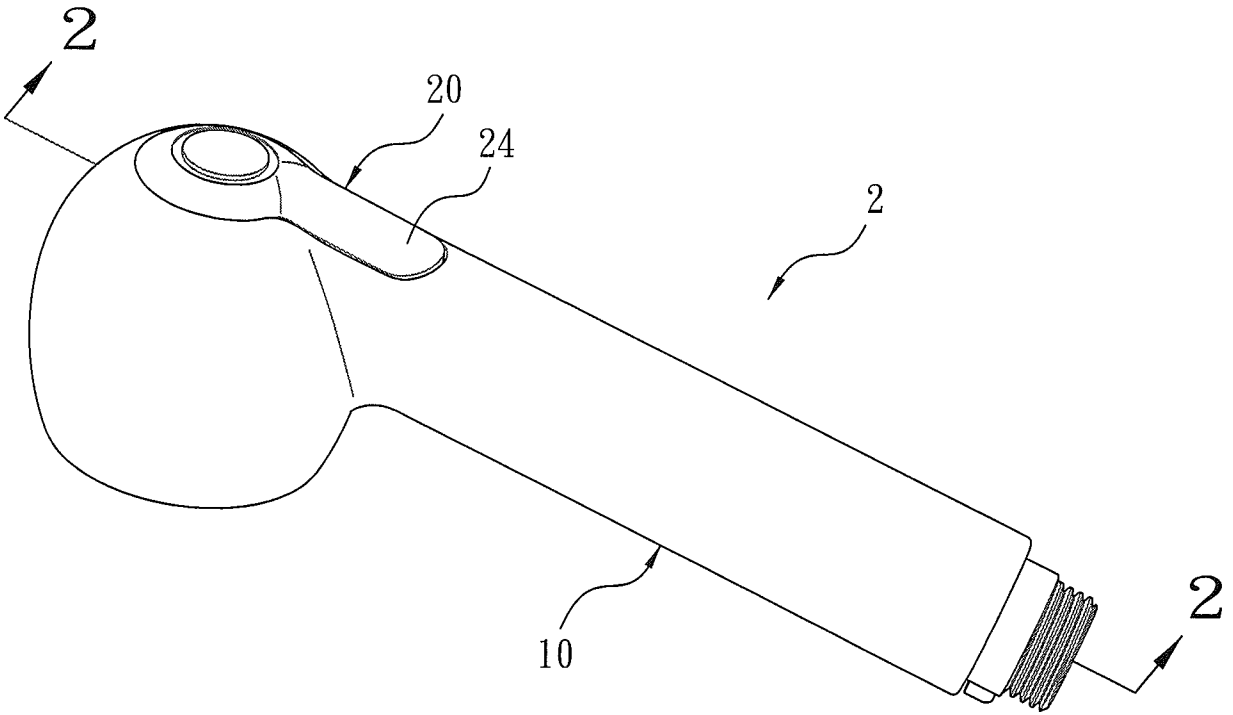
FIG. 8 is a perspective view showing the assembly of a water supply device with double supply modes according to a fourth embodiment of the present invention.
Figure 9:
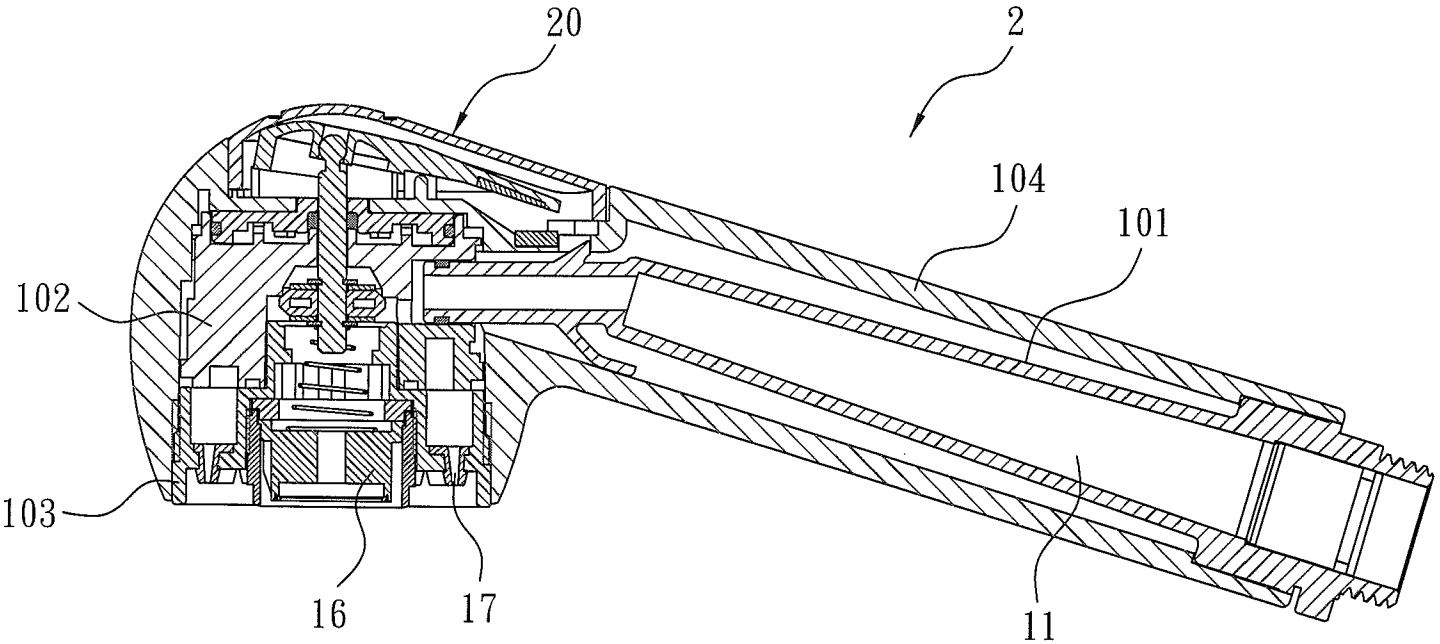
FIG. 9 is a cross sectional view taken along the line 2-2 of FIG. 8.
Figure 10:
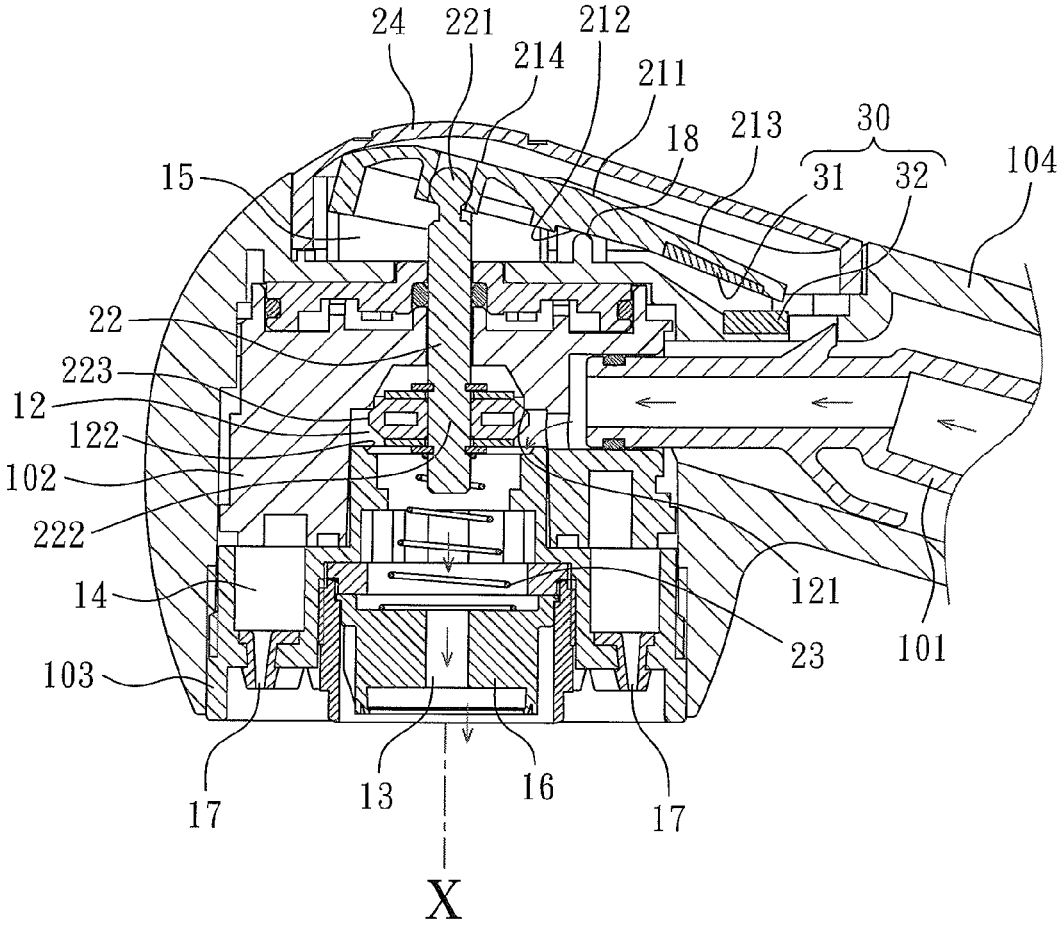
FIG. 10 is a cross sectional view showing the operation of a part of a water supply device with double supply modes according to a fourth embodiment of the present invention, wherein a closing portion of a distribution core is located at a first closing position, and a shower head is in a bubble level.
Figure 11:
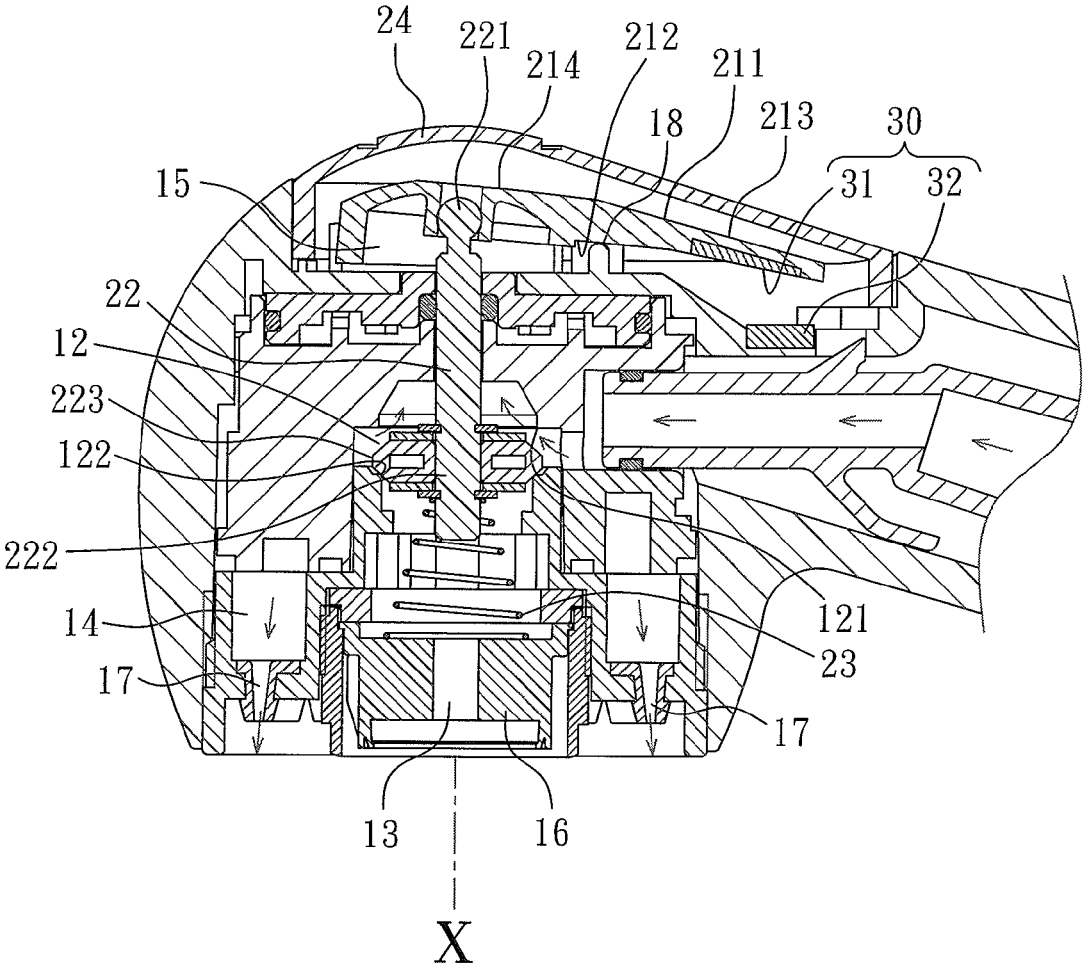
FIG. 11 is a cross sectional view showing the operation of a part of the water supply device with double supply modes according to the fourth embodiment of the present invention, wherein the closing portion of the distribution core is located at a second closing position, and the shower head is in a water level.

As illustrated in FIG. 7, a difference of a water supply device with double supply modes of a third embodiment from that of the first embodiment comprises:

a first attracting element 31 disposed on a connecting portion 221 of the distribution core 22; a second attracting element 32 mounted on an inner wall of the body 10 opposite to the first attracting element 31.

As shown in FIGS. 8-11, a difference of a water supply device with double supply modes of a fourth embodiment from that of the first embodiment comprises:

a water supply device being a shower head 2, and wherein a configuration between a press button 21 and a distribution core 22 is different from that of the first embodiment. For instance, a first sealing fence 121 is connected with a connecting portion 221 of the distribution core 22, and a first attracting element 31 is disposed on the first sealing fence 121 relative to a first pressing portion 213, and a second attracting element 32 is mounted on an inner wall of the body 10 opposite to the first attracting element 31.

A shifting mechanism 20 of the fourth embodiment further includes a flexible rubber sleeve 24 mounted on a receiving groove 15 of a housing part 104 so as to cover the press button 21, and the receiving groove 15 of the housing part 104 has a protrusion 18 extending outwardly therefrom, such that a first pressing portion 213 or a second pressing portion 214 of the press button 21 is pressed via the flexible rubber sleeve 24 so that the protrusion 18 swings forward and backward to drive the distribution core 22 to move along an axis line X.

Figure 12:
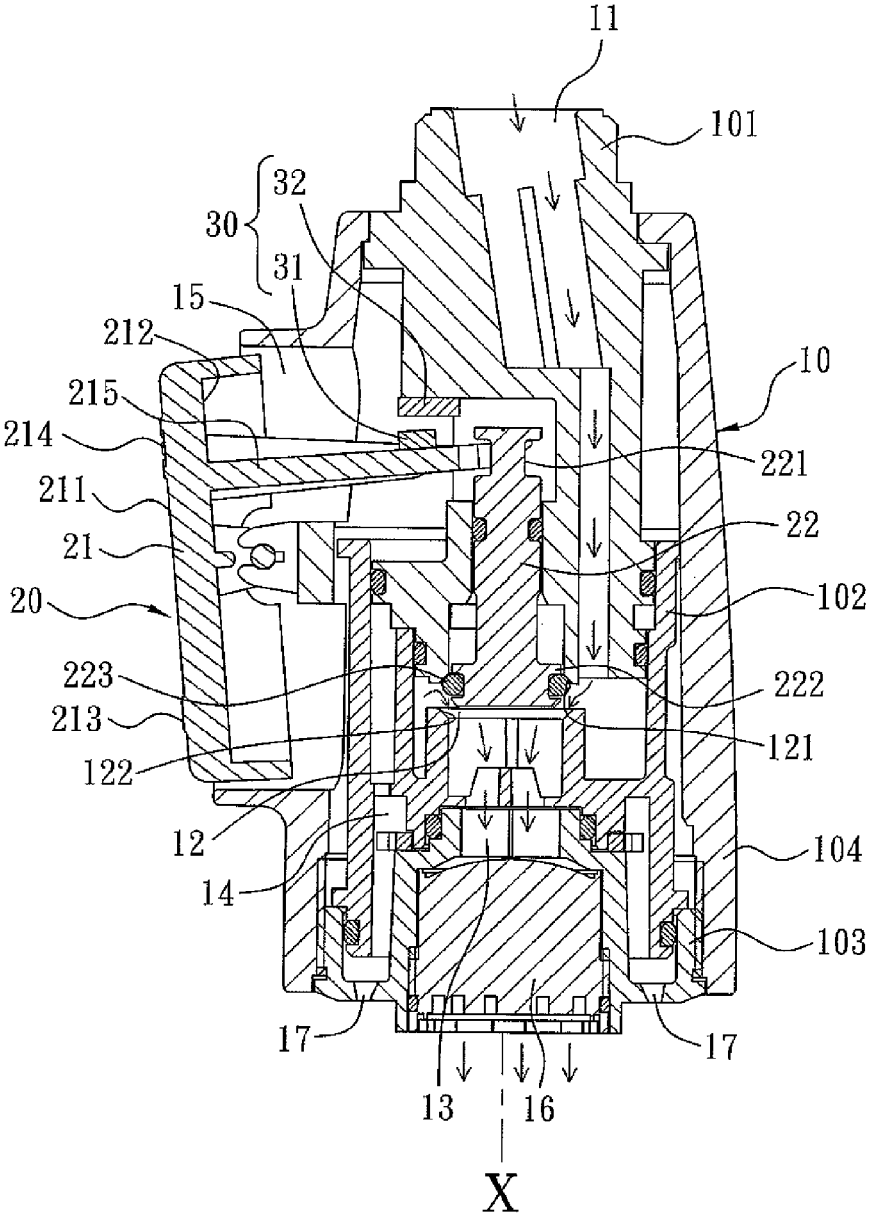
FIG. 12 is a cross sectional view showing the operation of a water supply device with double supply modes according to a fifth embodiment of the present invention, wherein a closing portion of a distribution core is located at a first closing position, and a pull-out is in a bubble level.

As shown in FIG. 12, a difference of a water supply device with double supply modes of a fifth embodiment from that of the first embodiment comprises: a first attracting element 31 and a second attracting element 32, and a magnetic attraction force generates between the first attracting element 31 and the second attracting element 32 to replace the elastic recovering force of the resilient element 23 of the first embodiment.

When the pull-out faucet 1 is in a closing state, the magnetic attraction force between the first attracting element 31 and the second attracting element 32 acts on the distribution core 22 so as to drive the closing portion 222 of the distribution core 22 to maintain on a first closing position. When the pull-out faucet 1 is turned on, it keeps in the bubble level stably. After the press button 21 is pressed, the closing portion 222 of the distribution core 22 moves to the second closing position, and since a farthest distance generates between the first attracting element 31 and the second attracting element 32, the magnetic attraction force between the first attracting element 31 and the second attracting element 32 becomes smallest, so even through water pressure in the water distributing cavity 12 is low or instable, it resists against the magnetic attraction force. In other words, a smallest magnetic attraction force between the first attracting element 31 and the second attracting element 32 drives the distribution core 22 in the closing state of the pull-out faucet 1 so that the closing portion 222 of the distribution core 22 moves to the first closing position.

Accordingly, the resilient element 23 of the first embodiment is eliminated from the water supply devices of the second, the third, and the fourth embodiments, and the bubble level and the water level of the water supply devices are shifted smoothly.

The magnetic attraction force between the first attracting element and the second attracting element and the magnetic attraction force between the third attracting element and the fourth attracting element are controlled by changing distance between the first attracting element and the second attracting element and distance between the third attracting element and the fourth attracting element. Furthermore, manufacturing material or magnetic field strength can be also used to control the magnetic attraction forces and the distances.

Thereby, the water supply device of the present invention has the following advantages:

1. When the water supply device is turned on, it maintains in the start level (i.e., the bubble level) stably.

2. The water supply device is shifted from the bubble level to the water level or is shifted from the water level to the bubble level smoothly.

3. The water supply device is shifted from the bubble level to the water level or is shifted from the water level to the bubble level easily at high water pressure.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A water supply device with double supply modes comprising:

a body including an inflow channel, a water distributing cavity communicating with the inflow channel, a first outflow channel and a second outflow channel which communicate with the water distributing cavity; the first outflow channel being arranged to produce a first water supply mode; the second outflow channel being configured to produce a second water supply mode;

a shifting mechanism including a press button connected with the body so as to swing frontward and backward after being pressed by a user; a distribution core having a connecting portion movably coupled with the press button and a closing portion located in the water distributing cavity of the body, the closing portion moving between a first closing portion and a second closing portion after the press button is pressed; when the closing portion moves to the first closing position, it stops the water distributing cavity communicating with the second outflow channel and guides waters in the water distributing cavity to flow into the first outflow channel; when the closing portion moves to the second closing position, it stops the water distributing cavity communicating with the first outflow channel and guides the waters in the water distributing cavity to flow into the second outflow channel;

a magnetic attraction device including a first attracting element and a second attracting element which magnetically attract each other; the first attracting element being disposed on the shifting mechanism; the second attracting element being mounted in the body opposite to the first attracting element; and the first attracting element moving to the first closing position with the distribution core so as to be close to the second attracting element, and the first attracting element moving to the second closing position with the distribution core so as to be away from the second attracting element.

2. The water supply device as claimed in claim 1, characterized in that the shifting mechanism further includes a resilient element for pushing the distribution core so that the closing portion of the distribution core moves back to the first closing position from the second closing position.

3. The water supply device as claimed in claim 1, characterized in that the first attracting element is a magnet or is made of magnetic material, and the second attracting element is a magnet or is made of magnetic material.

4. The water supply device as claimed in claim 1, characterized in that each of the first attracting element and the second attracting element is a magnet.

5. The water supply device as claimed in claim 1, characterized in that the press button has an external face for being pressed by the user and an internal face coupling with the body; the external face has a first pressing portion fixed on a first side thereof and a second pressing portion secured on a second side thereof, such that when the first pressing portion is pressed, the distribution core is driven to move toward the first closing position, and when the second pressing portion is pressed, the distribution core is driven to move toward the second closing position; the internal face further has a horizontal post extending outwardly therefrom so as to join with the distribution core and to fix the first attracting element to adjacent to a distal end of the horizontal post, and the second attracting element is disposed on an inner wall of the body opposite to the first attracting element.

6. The water supply device as claimed in claim 1, characterized in that the body further includes a water inflow part, a water allocating part connecting with an outlet end of the water inflow part, a water outflow part coupling with an outlet end of the water allocating part, and a housing part for accommodating the water inflow part, the water allocating part, and the water outflow part; the water inflow part has the inflow channel formed thereon; between the water inflow part and the water allocating part is defined the water distributing cavity; the water allocating part has most part of the second outflow channel arranged thereon; the water outflow part has the first outflow channel and an outlet end of the second outflow channel; the housing part has a receiving groove defined thereon so as to fix the press button.

7. The water supply device as claimed in claim 6, characterized in that the water distributing cavity includes a first sealing fence and a second sealing fence, the first sealing fence is formed by the water inflow part, and the second sealing fence is formed by the water allocating part; the closing portion of the distribution core has a gasket fitted thereon so that when the gasket is located at the first closing position, it closes the first sealing fence to stop the water distributing cavity communicating with the second outflow channel, and when the gasket is located at the second closing position, it closes the second sealing fence to stop the water distributing cavity communicating with the first outflow channel.

8. The water supply device as claimed in claim 6, characterized in that the first outflow channel of the water outflow part has a bubbler disposed on an outlet end thereof and located at a central portion of the water outflow part as to produce the first water spray mode to spray waters with bubbles; the second outflow channel of the water outflow part has a plurality of nozzles formed on the outlet end thereof and surrounding around the bubbler so as to produce the second water spray mode to spray waters.

9. The water supply device as claimed in claim 6, characterized in that the shifting mechanism further includes a resilient element, and the resilient element is a compression spring and is installed in the water distributing cavity, and the resilient element has two ends for abutting against the water outflow part and the distribution core, such that the closing portion of the distribution core moves back to the first closing position from the second closing position.

10. The water supply device as claimed in claim 1, characterized in that the first attracting element is disposed on the connecting portion of the distribution core; the second attracting element is mounted on an inner wall of the body opposite to the first attracting element.

11. The water supply device as claimed in claim 1, characterized in that the magnetic attraction device further includes a third attracting element disposed on the shifting mechanism and a fourth attracting element mounted in a body relative to the third attracting element, such that the third attracting element moves close to the fourth attracting element when it moves to the second closing position with the distribution core; and the third attracting element moves away from the fourth attracting element when it moves to the first closing position with the distribution core.

12. The water supply device as claimed in claim 11, characterized in that the shifting mechanism further includes a resilient element, and the resilient element is a compression spring for abutting against the distribution core, such that the closing portion of the distribution core moves back to the first closing position from the second closing position; when the closing portion of the distribution core is located at the second closing position, the resilient element has a largest elastic recovering force, a shortest distance between the third attracting element and the fourth attracting element produces, and a largest magnetic attraction force generates between the third attracting element and the fourth attracting generates, and the largest magnetic attraction force is less than the largest elastic recovering force.

13. The water supply device as claimed in claim 12, characterized in that when the closing portion of the distribution core is located at the second closing position, a farthest distance between the first attracting element and the second attracting element generates, and a smallest magnetic attraction force generates between the first attracting element and the second attracting produces, and the smallest magnetic attraction force is less than the largest magnetic attraction force between the third attracting element and the fourth attracting element.

14. The water supply device as claimed in claim 11, characterized in that the press button has an external face for being pressed by the user and an internal face coupling with the body; the external face has a first pressing portion fixed on a first side thereof and a second pressing portion secured on a second side thereof, such that when the first pressing portion is pressed, the distribution core is driven to move toward the first closing position, and when the second pressing portion is pressed, the distribution core is driven to move toward the second closing position; the internal face further has a horizontal post extending outwardly therefrom so as to join with the distribution core; the first attracting element and the third attracting element are fixed on two opposite sides of the horizontal post adjacent to a distal end of the horizontal post, and the second attracting element is secured on an inner wall of the body opposite to the first attracting element, the fourth attracting element is arranged on the inner wall of the body opposite to the third attracting element.

15. The water supply device as claimed in claim 1, characterized in that the press button has an external face for being pressed by the user and an internal face swinging on a protrusion of the body; the external face has a first pressing portion fixed on a first side thereof opposite to the protrusion and a second pressing portion secured on a second side thereof, such that when the first pressing portion is pressed, the distribution core is driven to move toward the first closing position, and when the second pressing portion is pressed, the distribution core is driven to move toward the second closing position; the first attracting element is mounted on one side of the internal face opposite to the first pressing portion, and the second attracting element is disposed on an inner wall of the body opposite to the first attracting element.

16. The water supply device as claimed in claim 2, characterized in that the resilient element is a compression spring.

17. The water supply device as claimed in claim 1, characterized in that the water supply device is a pull-out faucet.

18. The water supply device as claimed in claim 1, characterized in that the water supply device is a shower head.

* * * * *